US007221769B1

(12) United States Patent
Jorgensen

(10) Patent No.: US 7,221,769 B1
(45) Date of Patent: May 22, 2007

(54) HEARING AID ADAPTED FOR DISCRETE OPERATION

(75) Inventor: Martin Bondo Jorgensen, Smorum (DK)

(73) Assignee: Sonion Roskilde A/S, Roskilde (DK)

( * ) Notice: Subject to any disclaimer, the term of this patent is extended or adjusted under 35 U.S.C. 154(b) by 0 days.

(21) Appl. No.: 09/787,945

(22) PCT Filed: Sep. 15, 1999

(86) PCT No.: PCT/DK99/00485

§ 371 (c)(1),
(2), (4) Date: Jun. 26, 2001

(87) PCT Pub. No.: WO00/18187

PCT Pub. Date: Mar. 30, 2000

(30) Foreign Application Priority Data

Sep. 24, 1998 (DK) ..... 1998 01206

(51) Int. Cl.
*H04R 25/00* (2006.01)

(52) U.S. Cl. ..... 381/328; 381/329

(58) Field of Classification Search ..... 381/312, 381/314, 322–324, 327–329, 380–381, 330, 381/331

See application file for complete search history.

(56) References Cited

U.S. PATENT DOCUMENTS 3,227,836 A * 1/1966 Renwick, Sr. ..... 200/61.58 R
4,467,145 A * 8/1984 Borstel ..... 381/329
4,622,440 A * 11/1986 Slavin ..... 381/313
4,672,672 A * 6/1987 Eggert et al. ..... 381/324
4,727,582 A * 2/1988 de Vries et al. ..... 381/330
4,803,853 A * 2/1989 Hoerkens ..... 63/14.1
5,003,608 A * 3/1991 Carlson ..... 381/329
5,144,678 A * 9/1992 Lenz ..... 381/384
5,295,191 A * 3/1994 Van Vroenhoven ..... 381/329
5,347,584 A * 9/1994 Narisawa ..... 381/323
5,365,593 A * 11/1994 Greenwood et al. ..... 381/322
5,369,857 A * 12/1994 Sacherman et al. ..... 29/594
5,381,484 A * 1/1995 Claes et al. ..... 381/329
5,588,064 A * 12/1996 McSwiggen et al. ..... 381/312
5,600,728 A * 2/1997 Satre ..... 381/314
5,687,242 A * 11/1997 Iburg ..... 381/312
5,708,725 A * 1/1998 Ito ..... 381/370
6,532,294 B1 * 3/2003 Rudell ..... 381/315
6,775,390 B1 * 8/2004 Schmidt et al. ..... 381/371
2002/0071584 A1 * 6/2002 Rudolph et al. ..... 381/322

FOREIGN PATENT DOCUMENTS

GB A2030003 3/1980
WO A1-9613961 5/1996

* cited by examiner

*Primary Examiner*—Curtis Kuntz
*Assistant Examiner*—P. Dabney
(74) *Attorney, Agent, or Firm*—Harness, Dickey & Pierce, PLC

(57) ABSTRACT

The present invention relates to a hearing aid, which allows a hearing aid user to discretely operate his/her hearing aid by applying a force to a portion of the ear carrying the hearing aid. A number of different functions of the hearing aid, such as turning a battery supply on/off, adjusting a volume control, selecting a particular pre-programmed listening program, etc., may be provided in a hearing aid according to the present invention—all without directly engaging the hearing aid or switches or potentiometers thereof. Furthermore, if the hearing aid is adapted for use within the ear canal, the present invention may provide user assistance so to allow simple and convenient removal of the aid from the ear canal.

18 Claims, 4 Drawing Sheets

HEARING AID ADAPTED FOR DISCRETE OPERATION

FIELD OF THE INVENTION

The present invention relates to a hearing aid, which may be operated discretely by applying a force to the ear or its surroundings. A number of different functions of the hearing aid, such as turning a battery supply on/off, adjusting a volume control, shifting between a microphone and a telecoil input signal, etc., may be chosen or selected in the present hearing aid—all without directly engaging the hearing aid or switches or potentiometers thereof. Also, when the hearing aid is adapted for use within the ear canal, an easier removal thereof is provided.

BACKGROUND OF THE INVENTION

Hearing aid technology continuously strives toward developing smaller hearing aids or hearing instruments. This development is helped by a continuous reduction in size for all components commonly utilised in hearing aids.

The advent of in-the-canal (ITC) type of hearing aids and completely-in-the-canal (CIC) type of hearing aids has brought several benefits to hearing aid users. Many users or potential users find it cosmetically attractive to wear an aid that may be completely contained within the ear canal, since this renders the aid invisible, at least in a majority of everyday situations.

Further, hearing aids of the ITC and CIC types provide acoustical benefits compared to a behind-the-ear (BTE) type of instrument. One benefit is improved directional hearing due to a major part of the outer ear being left unblocked by the ITC and CIC hearing aids, thereby preserving the natural directional properties of the outer ear.

While the cosmetic and acoustic improvements related to the use of ITC and CIC hearing aids are well recognised, there remain a number of practical problems related to the daily use and operation of these types of aids.

A hearing aid is usually provided with one or several control means, such as push buttons, switches, etc., which may be located on a face part of the hearing aid housing.

The control means may be adapted to provide a number of functions, such as turning the aid on/off, controlling a gain, changing between a number of predetermined listening programs, changing between a microphone signal and a telecoil signal, etc.

A first practical problem is the difficult operation of controlling means mounted on the face of the housing of the hearing aid. This problem originates from e.g. the inaccessible position of the hearing aid deep inside the ear canal, which normally makes it difficult for a user to find and properly operate the controlling means. The very limited available area of the face part of the aid further adds to this problem, since any controlling means must have very small physical dimensions to fit on the face of the housing. This problem is pronounced for elderly people, which constitute the majority of hearing aid users, since they often have reduced capability to perform the necessary tiny movements of the controlling means with their fingertips.

A second problem is that it may be very difficult for the user to remove an ITC and especially a CIC type aid from its clamped-in position in the ear canal.

A solution to the problem of removing the aid is disclosed in U.S. Pat. No. 5,381,484 wherein a pull-out string with beads is attached to a face part of a housing of a CIC aid. The beads provided on the string enables the user to get a firm grip on the string and apply the force necessary to release the aid.

This solution, however, creates a derived third problem, since, during the release process, an acoustic leakage path is inevitably created in the ear canal between the microphone mounted on the face part and a sound emitting transducer (receiver) of the hearing aid. This leakage path will usually make the hearing aid oscillate at a high frequency and at full output power, producing a sustained and highly irritating noise into the ear of the user until the battery supply is turned off, or the gain is turned down. Also, a string pointing out of the ear is not desirable for cosmetic reasons.

SUMMARY OF THE INVENTION

It is an object of the invention to solve these two above mentioned basic problems and the third derived problem.

In a first aspect, the invention provides a hearing aid comprising a housing and means for controlling an operation mode of the hearing aid, wherein said controlling means are adapted to be responsive to a force applied to a part of an auricle of the hearing aid user.

Thus, the hearing aid may be operated by applying a force to a part of the outer ear instead of manipulating small switches or control buttons mounted on the face part of the hearing aid, when the aid is positioned e.g. inside the ear canal. This operation method may replace all or at least some of the functions traditionally provided by control switches and push buttons on the face part of the hearing aid.

In this manner, a more discrete and convenient operation of the hearing aid is obtained.

Thus, the hearing aid user may operate the hearing aid by applying a pressure with his/hers finger to a predetermined part of the outer ear. As will be clear from the following, different types of hearing aids may be adapted to use different parts of the ear.

In one embodiment, the hearing aid is of the BTE type, where the housing is adapted to be placed at a position behind the ear, and wherein the controlling means comprise sensing means positioned on at least one side of the hearing aid housing facing the head or facing the ear lobe of the user, the sensing means being adapted to sense a force applied to the user's auricle, and the controlling means being responsive to the sensing of the sensing means. In this embodiment, the predetermined part of the outer ear may be the tail of the helix. The sensing means may, in this situation, be mounted on a side of the BTE housing, in such a manner that the means senses the applied force.

In another embodiment, the housing is adapted to be placed within the ear canal, which is the case for hearing aids of the CIC or ITC type. In this situation, the predetermined part of the auricle that receives the applied force may be the tragus.

In this embodiment, the controlling means preferably comprise a stiff lever having two ends, a first end, which may be attached to a switching means or a face part of the housing. The lever, further, being adapted to be deflected by application of the force to the auricle, such as to a tragus, of the ear, and the controlling means being responsive to the deflection of the lever Thus, the lever preferably possesses a suitable stiffness to transfer at least a part of the applied force to the controlling means. Preferably, a second end of this lever is placed within the ear canal at a position in close proximity to e.g. the inside part of the tragus of the user's ear.

Since the dimensions and colours of human ears vary widely, it may be advantageous to produce a number of levers in different lengths and colours. Further, due to these anatomic variations, it may be advantageous to provide the levers with a number of different mounting angles between the face plate of the hearing aid and the lever, the angle variation, preferably, being restricted to the range from 60–120 degrees.

In the situation wherein a number of different levers are provided, the hearing aid may be manufactured with a detachable connection between the hearing aid housing and the lever. The place at which the hearing aid is fitted to the user, often a dispensing office, may stock a number of levers of differing lengths, colours and mounting angles. The fitting procedure at the dispensing office may include the step of selecting the size and/or the shape and/or the mounting angle of the lever to properly position it in close proximity to e.g. the tragus of the user's ear. The lever may, thereby, be adequately deflected from its rest position, when a force is applied to the tragus, and a response may be generated in the controlling means.

Also, hearing aids of the CIC or ITC types may be shaped on the basis of the actual shape of the ear canal of the user. In this process of moulding the outer contours of the hearing aid, the shape of the lever may be determined or selected—or even custom made.

Also, the stiff lever may be used for a second purpose. The lever may further be adapted to assist the user in removing the hearing aid from the ear canal. Thus, preferably the lever further comprises engaging means adapted to facilitate engagement with the hearing aid during removal. Naturally, this removal may be performed by the user using his/her fingers or by using a tool. Especially when a tool is used, it is preferred that the engaging means comprise a loop-shaped or hook-shaped part.

A major advantage of using the present lever is the fact that it is at least relatively stiff, which means that the engaging means will remain in at least substantially the same, predetermined position during normal use and movements by the user. In this manner, the position thereof is well known and removal of the hearing aid easier. Also, when using an extraction tool, the engaging means may be positioned farther (and, thus, more invisible) into the ear canal than if they were to be engaged by a finger of the user.

The engaging means are preferably shaped so that the lever is provided with a loop-shaped outline and being suitable for mass production through the use of an injection mould. The loop-shaped outline is advantageous since it provides a firm grip for the fingers of the hearing aid user, thereby helping him/her to release the hearing aid from the ear canal without the use of extraction tools.

The exact manner in which the deflection of the lever is detected and used by the controlling means to control the manner of operation may differ widely. However, preferably the controlling means comprises a switching means, such as an on/off switch, a momentary switch, etc. adapted to control the operation mode of the hearing aid, the switching means being responsive to the deflection of the stiff lever.

In the situation where the controlling means are provided with a momentary switch, the switch element is, preferably, responsive to an applied force of between 0.5–5.0 Newton, even more preferably around 0.8 Newton. The term "being responsive to" means that the switch element will change from one state to another state.

Thus, the level is, preferably, provided with a stiffness sufficiently large to convey a pressure force of at least 0.8 Newton, or more preferably at least 0.5 Newton to the switch element. A suitably constructed lever will convey the pressure force to the switch element, if the force is applied along the length axis of the lever or if the force is applied perpendicularly to the length axis of the lever.

The stiffness of the lever will, of course, depend on its shape and its dimensions, such as its length, as well as the type of material used for it.

The stiffness of the lever may be tested by selecting a 5 mm long lever and at the first end provide a fixed restraining of the lever, and subsequently applying a force of 0.8 N at the second end of the lever where the force is applied substantially perpendicularly to the length axis. Subsequently, the deflection of the second end, resulting from the applied. pressure, is measured. A 5 mm long lever suitable for application in the present invention has, preferably, a deflection within the interval 0–5 mm, more preferably within the interval 0–2 mm, even more preferably within the interval 0–1 mm.

The deflection of the lever is measured in its least stiff direction, if the lever is unsymmetrical about the length axis.

The lever is, preferably, provided with a length, lg, within the interval 4–10 mm. The stiffness of the lever of any of these lengths may be tested as described above, and the deflection is, preferably, within the interval 0–1.0*lg mm, more preferably within the interval 0–0.4*lg mm, even more preferably within the interval 0–0.2*lg mm.

The lever is, preferably provided in metal or a thermoplastic material, but a lever of adequate stiffness as defined above, may be provided in a large variety of materials, dimensions and shapes.

Thus, the switching means may be mechanically connected to the stiff lever, and a force applied to e.g. the tragus of the user's ear will cause the switching means to change its state. This change of state may be sensed by the controlling means, and as a response the controlling means may change the operation mode of the hearing aid.

Measurements, performed by the inventor, on ears of a variety of individuals have revealed that a force applied to the tragus in the range of 30–50 grams, equivalent to 0.3–0.5 Newton, will displace the tragus with approximately 0.5–1.0 cm from its rest position on an average individual.

In response to this deflection of the tragus, the lever may be deflected and thereby convey a sufficient part of the applied force to the switching means to change its state.

The momentary switch may be one, which provides two different states. The states may be provided as a first state wherein two legs of the switch are shorted and a second state wherein the two legs are open i.e. having a substantially infinite resistance between them.

The two states of the switch may further be provided as a corresponding electrical signal representing these states, such as zero (ground) signal and Vbat (positive power supply) signal, and this electrical signal may be sensed by the controlling means, thereby providing a hearing aid wherein the switching means are adapted to alternate an electrical signal level between two predetermined levels, the controlling means being adapted to control the operation mode in response to a change in the electrical signal level provided by the switching means.

The controlling means may comprise an integrated circuit, such as a CMOS circuit, a Bipolar circuit, a BiCMOS circuit, etc. The integrated circuit may, further, comprise logic means adapted to control the operation of the hearing aid.

In one embodiment, the electrical signal provided by the switching means is adapted to control the battery supply on/off operation mode of the hearing aid. This embodiment is particularly well suited for CIC hearing aids, since these aids, by their nature, are located deep inside the ear canal where it is difficult for the user to locate and operate traditional switches or push buttons. The present invention provides a better solution for the hearing aid user to this tedious switching operation, since the invention may provide a CIC hearing aid wherein the battery supply on/off is controlled by depressing the tragus of the ear.

In another embodiment, the controlling means may be adapted to control a microphone/telecoil input signal selection from the change in the electrical signal level provided by the switching means.

In yet another embodiment, the controlling means are adapted to select a particular pre-set listening program between a number of pre-set listening programs comprised in the hearing aid. An EEPROM in the hearing aid may comprise several different listening programs that have been selected and subsequently loaded into the EEPROM at a dispensing office.

In the situation where the switching means comprises a momentary switch and the controlling means further comprises an integrated circuit, the operation mode change of the hearing aid may be activated only after the tragus has been depressed during a predetermined time interval. This predetermined time interval may be controlled by the integrated circuit. By choosing a suitable time interval, accidental activation of the operation mode control may be prevented or minimised by "normally" occurring touches and scratches of the tragus. In a second aspect of the invention, the controlling means comprise a rigid lever with an engaging means that provides the hearing aid user with a firm grip, so that he/she may release the hearing aid from the ear canal. In this aspect, the invention relates to a hearing aid adapted to be positioned within an ear canal of an ear of a user, the hearing aid comprising means for manually removing the hearing aid from the canal, the removing means being fastened to the hearing aid and extending from the hearing aid toward an auricle of the ear, and wherein the removing means comprise a stiff member adapted to remain in essentially the same predetermined position at least during normal movements of the user.

BRIEF DESCRIPTION OF THE DRAWINGS

In the following, a preferred embodiment of a controlling means according to the invention will be described for use in a CIC type of hearing aid, and in relation to the drawing wherein.

DETAILED DESCRIPTION OF A PREFERRED EMBODIMENT

Figure 1:
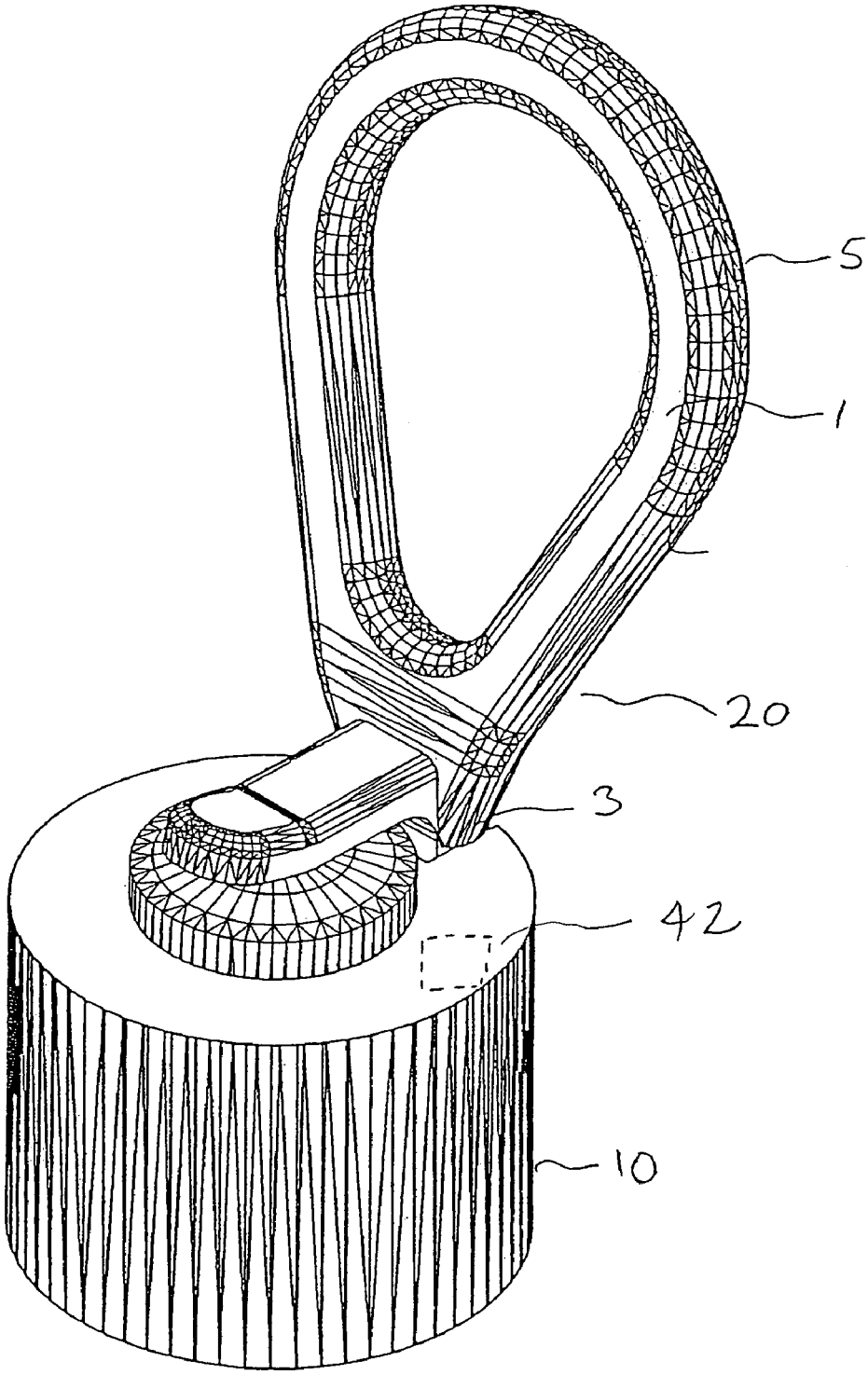
FIG. 1 shows a perspective view of a controlling means comprising a loop shaped stiff lever.

FIG. 1 shows a perspective view of a controlling means 20, which is adapted for use in a CIC type of hearing aid. The controlling means comprises stiff lever 1 with a loop shaped outline 5, a switch unit 10 of the momentary type. The stiff lever is, preferably, manufactured in a metal or a thermo-plastic material, the latter may comprise reinforcement. Both types of materials may provide a lever of suitable stiffness in the preferred shape or shapes. The loop-shaped lever constitutes an engaging means, and a part of the lever may be provided with a ribbed pattern, thereby providing the hearing aid user with an item that may be firmly gripped with the fingers and used to pull out the aid from the ear canal.

Figure 2:
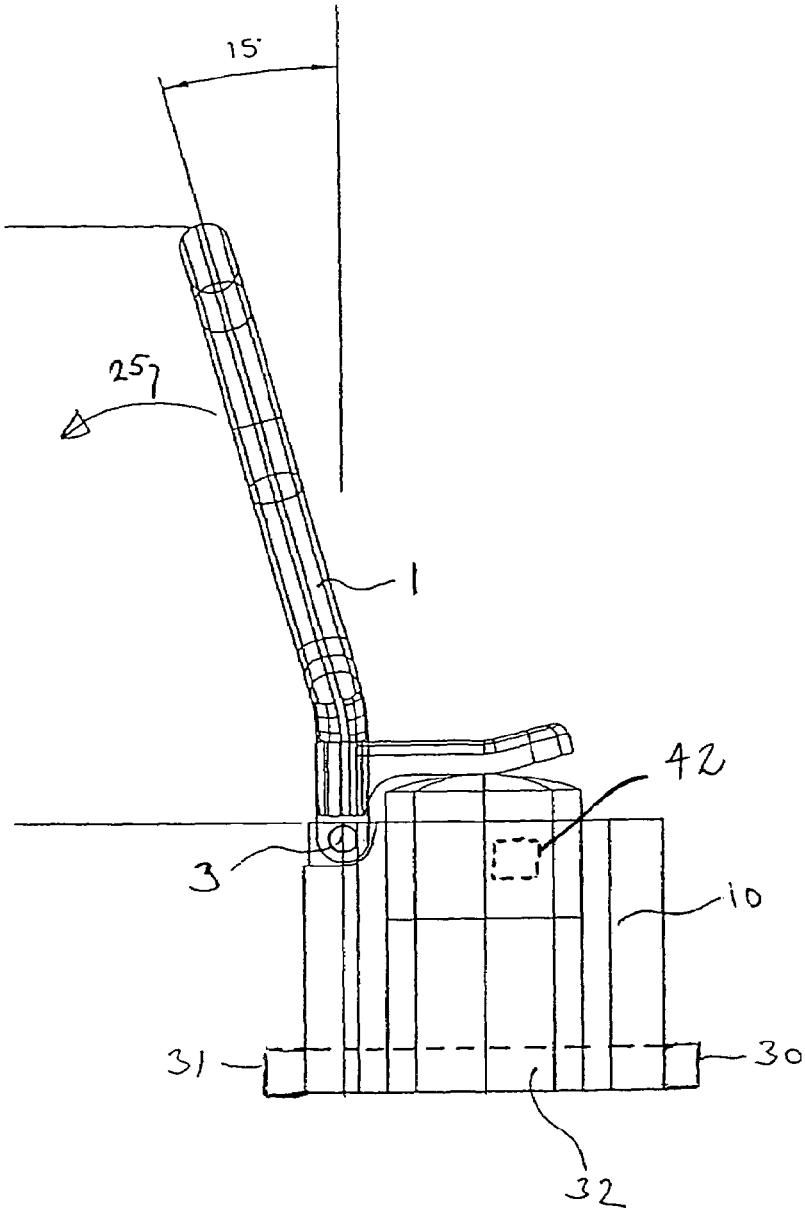
FIG. 2 shows a side view of the controlling means.
Figure 4:
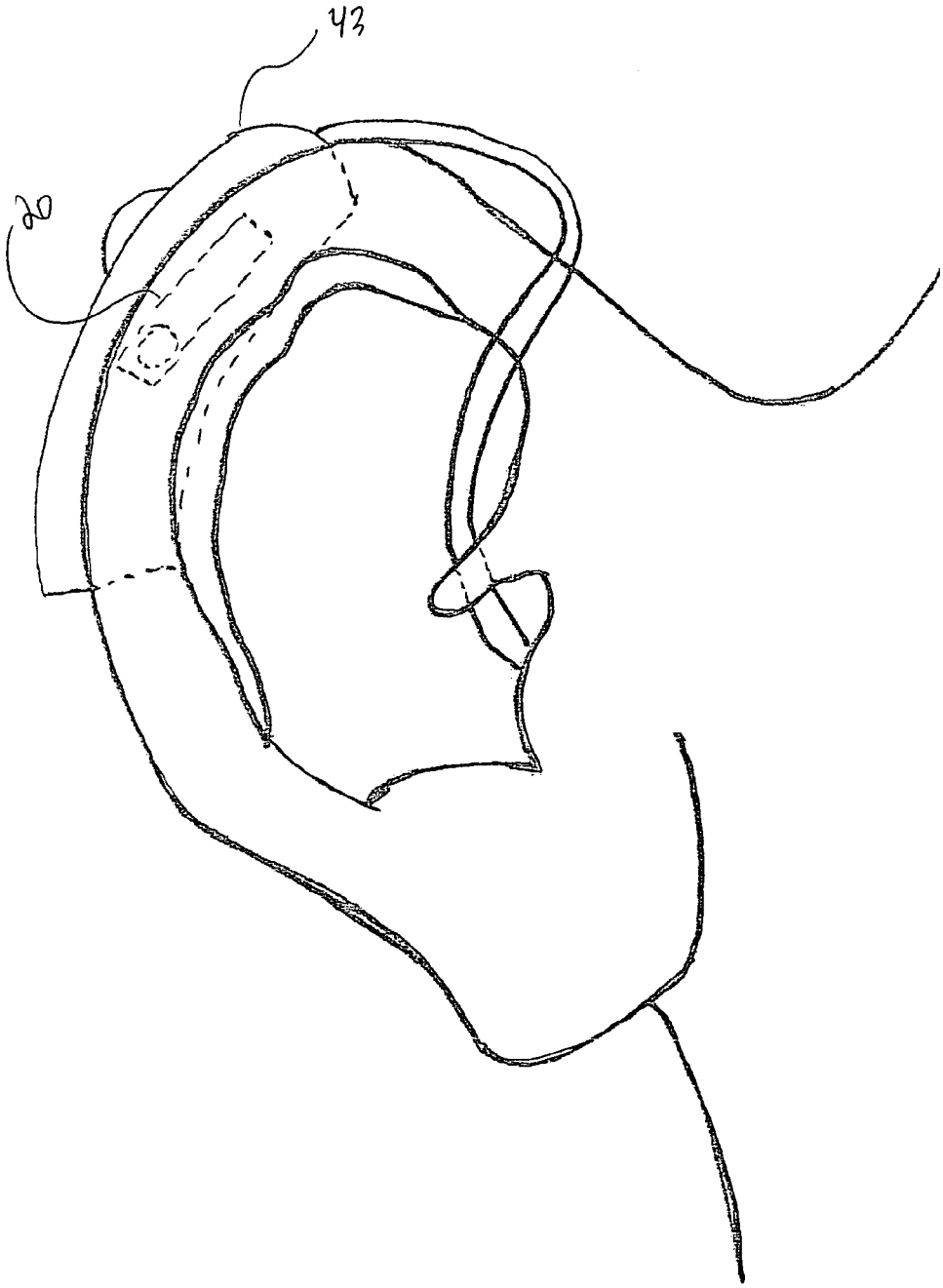
FIG. 4 illustrates a housing positioned behind an ear with a controlling means according to an example embodiment of the present invention.

The switch unit 10 comprises two gold-coated electrical contacts as seen on FIG. 2 items 30 and 31. This unit 10 may be attached to a face part of a hearing aid housing 43 as illustrated in FIG. 4. The contacts 30 and 31 may be connected by means of electrical conductors to a control circuit (not shown). The control circuit may sense the electrical signal on a single or both contacts to determine the state of the switch i.e. whether the switch is in its rest position or in its active position.

Preferably, one of the switch contacts 30 and 31 provides one of two different DC voltages 0 volt and battery supply voltage (VBAT) to the control circuit 42 depending upon the state of the switch.

FIG. 2 shows a side view of the controlling means 20 with the stiff lever 1 in a rest position. The arrow 25 indicates the direction to which the stiff lever 1 is deflected when a force is applied to it. The stiff lever 1 is attached to the switch unit 10 by pivot pin 3. A circular flange 32 is further provided to securely fasten the controlling means 20 of FIG. 1 to the face part of the hearing aid housing when a "pull-out force" is applied to the stiff lever 1.

When the deflection of the stiff lever 1, around the pivotal pin 3, is larger than approximately 15 degrees, the electrical contact provided between contacts 30 and 31 in the rest position with zero deflection, is disconnected. This disconnection is sustained until the applied force acting upon the lever 1 is removed. When the applied force is removed, a spring (not shown) surrounding the pivotal pin 3 provides a force, which is adapted to move the stiff lever 1 back to its rest position, and thus the contacts 30 and 31 again into electrical contact.

Figure 3:
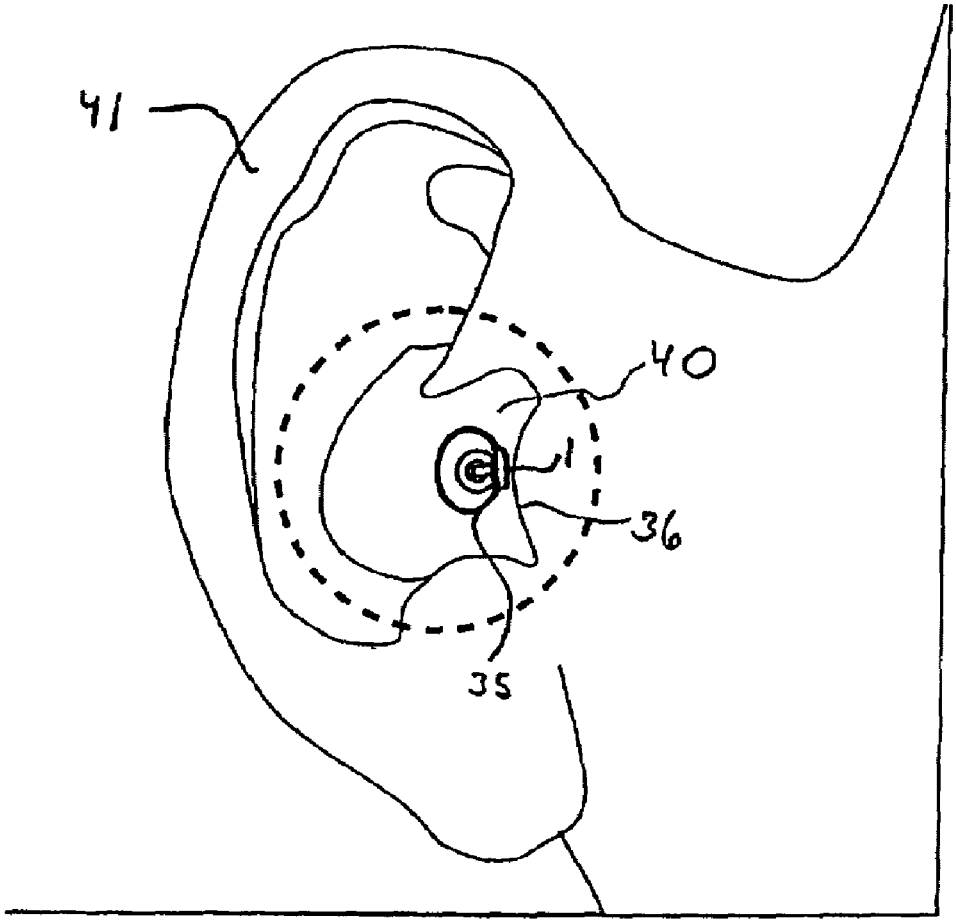
FIG. 3 is an illustration of a CIC hearing aid comprising a loop-shaped stiff lever and mounted in an ear canal.

FIG. 3 shows a CIC type of hearing aid 35 mounted in an ear canal 40 of a hearing aid user. The aid comprises controlling means with a loop-shaped stiff lever 1, which is mounted in close proximity to a tragus 36 on an auricle 41 of the hearing aid user.

The invention claimed is:

1. A hearing aid comprising, a housing and means for controlling an operation mode of the hearing aid, wherein said controlling means are adapted to be responsive to a force applied by a hearing aid user's finger to a part of the user's auricle.

2. A hearing aid according to claim 1, wherein the housing is adapted to be placed at a position behind the ear, and wherein the controlling means comprise sensing means positioned on at least one side of the housing facing the head or facing the ear lobe of the user, the sensing means being adapted to sense a force applied to the user's auricle, and the controlling means being responsive to the sensing of the sensing means.

3. A hearing aid according to claim 1, wherein the housing is adapted to be placed within an ear canal of the ear.

4. A hearing aid according to claim 3, wherein the controlling means comprise a stiff lever having two ends, one of which is attached to a face part of the housing, the lever being adapted to be deflected by application of the force to the auricle, such as a tragus, of the ear, and the controlling means being responsive to the deflection of the lever.

5. A hearing aid according to claim 4, wherein the lever is adapted to also be used by the user to remove the hearing aid from the ear canal.

6. A hearing aid according to the claim 5, wherein the level further comprises engaging means adapted to facilitate engagement with the hearing aid during removal.

7. A hearing aid according to claim 6, wherein the engaging means comprises a loop-shaped or hook-shaped part.

8. A hearing aid according to claim 4, wherein the controlling means comprises switching means adapted to control the operation mode of the hearing aid, the switching means being responsive to the deflection of the stiff lever.

9. A hearing aid according to claim 8, wherein the switching means comprises a momentary switch.

10. A hearing according to claim 8, wherein the switching means comprises an on/off switch.

11. A hearing aid according to claim 4, wherein the stiffness of the lever is large enough to convey at least a pressure force of 5.0 Newton to the switch element.

12. A hearing aid according to claim 11, wherein the pressure force is applied perpendicular to the length axis of the lever.

13. A hearing aid according to claim 9, wherein said switching means are adapted to switch an electrical signal between two predetermined levels, the controlling means being adapted to control the operation mode in response to a change in the electrical signal level provided by the switching means.

14. A hearing aid according to claim 1, wherein the controlling means are adapted to control a power on/off operation mode of the hearing aid.

15. A hearing aid according to claim 1, wherein the controlling means are adapted to select a particular pre-set listening program between a number of pre-set listening programs in the hearing aid.

16. A hearing aid according to claim 1, wherein the controlling means are adapted to control a telecoil/microphone operation mode of the hearing aid.

17. A hearing aid according to claim 1, wherein the controlling means further comprises an integrated circuit.

18. A hearing aid adapted to be positioned within an ear canal of an ear of a user, the hearing aid comprising a housing and means for manually removing the hearing aid from the canal, the removing means being fastened to the hearing aid and extending from the hearing aid toward an auricle of the ear, wherein the removing means comprise a stiff member adapted to remain in essentially the same predetermined position at least during normal deflection of said stiff member relative to the housing.

* * * * *